US008621821B1

(12) United States Patent
Wallace, Jr.

(10) Patent No.: US 8,621,821 B1
(45) Date of Patent: Jan. 7, 2014

(54) APPARATUS AND METHOD FOR MOUNTING A GUTTER

(71) Applicant: Robert J. Wallace, Jr., Nicholson, PA (US)

(72) Inventor: Robert J. Wallace, Jr., Nicholson, PA (US)

( * ) Notice: Subject to any disclaimer, the term of this patent is extended or adjusted under 35 U.S.C. 154(b) by 0 days.

(21) Appl. No.: 13/781,032

(22) Filed: Feb. 28, 2013

Related U.S. Application Data

(60) Provisional application No. 61/739,369, filed on Dec. 19, 2012.

(51) Int. Cl.
*E04D 13/00* (2006.01)
*E04D 15/00* (2006.01)
*E04F 21/00* (2006.01)

(52) U.S. Cl.
USPC ..... 52/749.1; 52/11

(58) Field of Classification Search
USPC ..... 52/11, 12, 13, 14, 15, 16, 749.1, 750
See application file for complete search history.

(56) References Cited

U.S. PATENT DOCUMENTS 2,686,960 A * 8/1954 Le Roy ..... 269/46
3,295,803 A * 1/1967 Blayden ..... 248/48.2
3,436,877 A * 4/1969 Gunning ..... 52/11
3,507,078 A * 4/1970 Sayers, Sr. ..... 52/15
3,664,071 A * 5/1972 Gallagher ..... 52/15
4,579,303 A * 4/1986 Midlik ..... 248/48.2
4,631,875 A * 12/1986 Olson ..... 52/12
4,705,242 A * 11/1987 Yost ..... 248/481
4,874,123 A * 10/1989 Mercer et al. ..... 227/147
4,910,926 A * 3/1990 Paulsson ..... 52/11
5,303,521 A * 4/1994 Jansen ..... 52/94
5,768,830 A * 6/1998 Kelly ..... 52/127.1
6,978,577 B2 * 12/2005 Jones ..... 52/11
7,216,458 B2 * 5/2007 Taouil ..... 52/11
8,250,821 B1 * 8/2012 Gibson ..... 52/302.3
2005/0108951 A1 * 5/2005 McDonald et al. ..... 52/11
2005/0252096 A1 * 11/2005 Staggs ..... 52/11
2006/0156636 A1 * 7/2006 Walker et al. ..... 52/11

FOREIGN PATENT DOCUMENTS

JP 10183904 A * 7/1998 ..... E04D 13/072

* cited by examiner

*Primary Examiner* — Ryan Kwiecinski
(74) *Attorney, Agent, or Firm* — Wood, Phillips, Katz, Clark & Mortimer

(57) ABSTRACT

The combination of a gutter piece and a gauging apparatus. The gutter piece has a length, a front, a rear, a bottom and a top. The gutter piece has an upwardly opening "U" shape, as viewed in cross-section taken transversely to the length of the gutter piece, for accumulating water and guiding accumulated water in a lengthwise direction. The gauging apparatus is operatively attached to the gutter piece and has a front and rear and a projecting portion to abut a surface on a structure to which the gutter piece is attached so as to thereby allow the gutter piece to be consistently aligned with the structure in a direction lengthwise of the gutter piece.

17 Claims, 10 Drawing Sheets

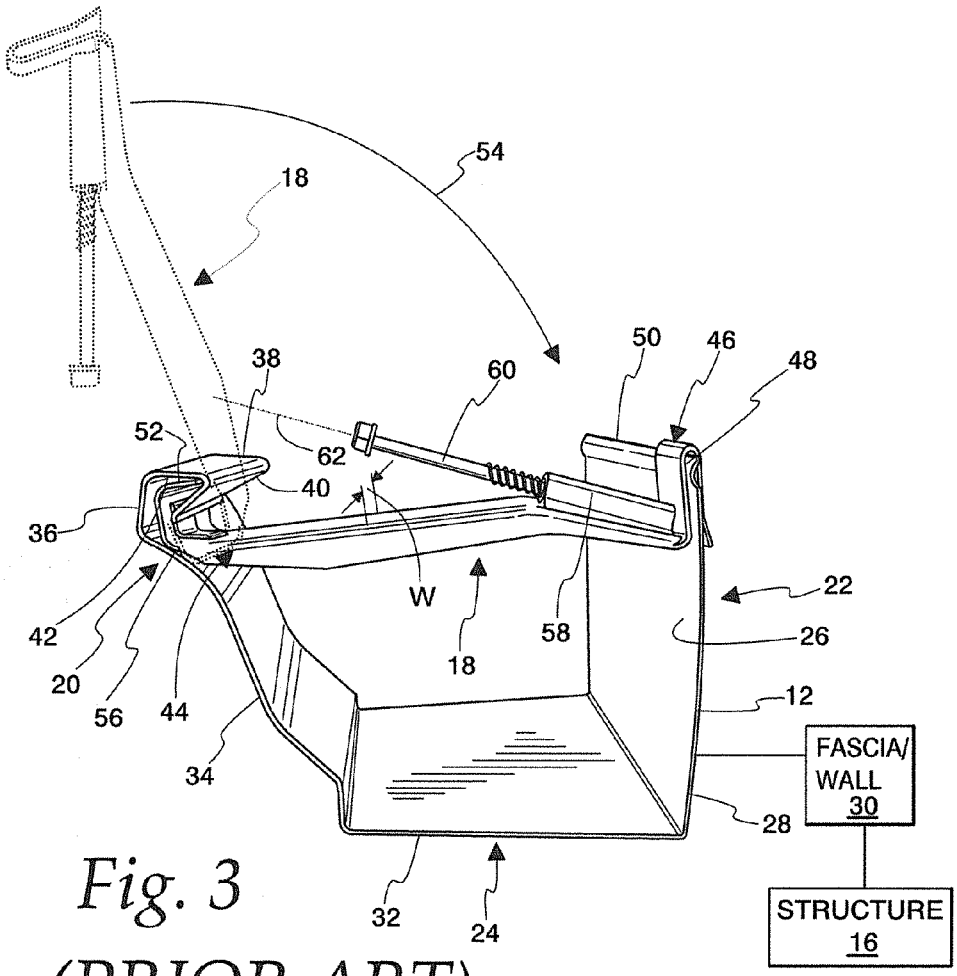
Fig. 3
(PRIOR ART)
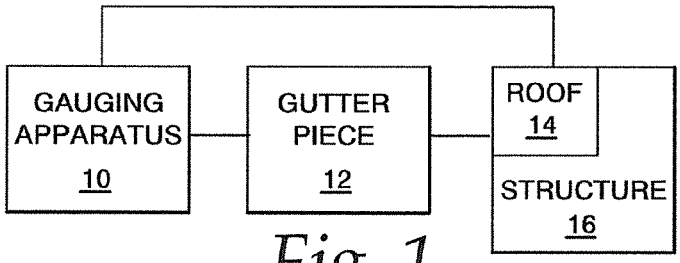
Fig. 1
Fig. 2
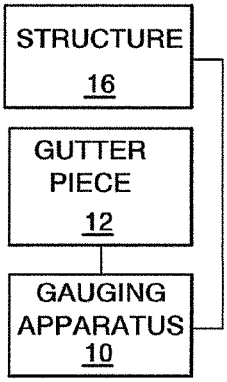

APPARATUS AND METHOD FOR MOUNTING A GUTTER

BACKGROUND OF THE INVENTION

1. Field of the Invention

This invention relates to gutters and, more particularly, to an apparatus that facilitates consistent lengthwise positioning of a gutter length relative to a roof margin during mounting thereof. The invention is also directed to a method of mounting a gutter using the apparatus.

2. Background Art

Many different systems have been devised for mounting gutters on buildings. Commonly, the lengths of gutter are installed serially, end-to-end, beginning from one end of a fascia. Typically, the free end of the first placed gutter length at the end of the fascia extends lengthwise beyond the roof line to intercept the path of virtually all water that flows down the roof at that region. Installers have different preferences as to whether the free end of the gutter should be flush with the roof line in a lengthwise direction, or extend some distance therebeyond. The selection of the mounting method takes into consideration both function and aesthetics. Regardless of the lengthwise situation of the gutter end on the fascia, installers typically want consistency around the perimeter of a building structure.

Heretofore, installers have set the free end of the endmost gutter length using either an eyeballing technique or by measuring overhang, typically by using a tape measure or rule. As a result, the installer is left with only one hand to manipulate the gutter as positioning is effected. Aside from the inconvenience, the need to handle tools, fasteners, and the gutter length may compromise the installer's balance. This problem is contended with when the installer is situated either on a ladder or on the roof structure during the installation process. The inconvenience, and even potential danger, become more prevalent on multi-story units where installers are required to function potentially at significant heights.

In spite of the inconvenience, and even potential dangers associated with hanging particularly the initial endmost gutter lengths, the industry has used the above-mentioned, age old techniques of placing gutter lengths in a desired lengthwise position preparatory to attachment. There has been, and continues to be, a need for better techniques and tools for effecting gutter installation.

SUMMARY OF THE INVENTION

In one form, the invention is directed to the combination of a gutter piece and a gauging apparatus. The gutter piece has a length, a front, a rear, a bottom and a top. The gutter piece has an upwardly opening "U" shape, as viewed in cross-section taken transversely to the length of the gutter piece, for accumulating water and guiding accumulated water in a lengthwise direction. The gauging apparatus is operatively attached to the gutter piece and has a front and rear and a projecting portion to abut a surface on a structure to which the gutter piece is attached so as to thereby allow the gutter piece to be consistently aligned with the structure in a direction lengthwise of the gutter piece.

In one form, the gauging apparatus is releasably operatively attached to the gutter piece.

In one form, the gauging apparatus is operatively attached to the gutter piece without requiring any separate fasteners.

In one form, there is a downwardly and/or forwardly opening U-shaped portion defining a receptacle at the front of the gutter piece. The gauging apparatus has a front leg that is directed into the receptacle with the gauging apparatus operatively attached.

In one form, the gauging apparatus is one of: a) wedged; and b) spanning between spaced first and second parts of the gutter piece that are respectively at first and second locations spaced in a direction between the front and rear of the gutter piece.

In one form, the gauging apparatus has a "J"-shaped portion with a base, a short leg, that is the front leg, and a longer leg. The longer leg connects to a first wall that extends rearwardly to the second location.

In one form, the gauging apparatus is wedged into the receptacle so as to be maintained operatively attached through wedging forces produced between the gutter piece and gauging apparatus at the front of the gutter piece.

In one form, the gutter piece has an upwardly facing ledge and the first wall is supported on the upwardly facing ledge at the second location.

In one form, the gauging apparatus further includes a locating leg that has a length that projects in cantilever fashion from the first wall and defines the portion that projects to beyond the "U" shape of the gutter piece.

In one form, the locating leg projects vertically upwardly from the first wall.

In one form, the locating leg has a substantially flat shape residing in a plane that is generally parallel to the length of the gutter piece.

In one form, the gauging apparatus has a body with a single piece defining the locating leg, the first wall, and the J-shaped portion.

In one form, the first wall has a substantially straight edge that abuts to the gutter piece along the length of the gutter piece.

In one form, there is at least one locating mark on at least one of the gutter piece and gauging apparatus usable to facilitate consistent placement of the gutter piece and gauging apparatus in a predetermined lengthwise relationship.

In one form, there are a plurality of locating marks on one of the gutter piece and gauging apparatus usable to facilitate consistent placement of the gutter piece and gauging apparatus in first and second different pre-determined lengthwise relationships.

In one form, the gauging apparatus fully spans between the front and rear of the gutter piece.

In one form, the single piece is shaped from a flat blank of metal.

In one form, the invention is directed to a method of installing the gutter piece, as described above, upon a structure having a fascia and a roof with an edge surface. The method includes the steps of: providing the gauging apparatus, as described above; operatively attaching the gauging apparatus to the gutter piece, moving the gutter piece along the fascia in a direction generally parallel to the gutter piece length to cause the gauging apparatus to abut the roof edge surface at which point the gutter piece is operatively situated; and with the gutter piece operatively situated, securing the gutter piece to the structure.

In one form, the method further includes the step of separating the gauging apparatus from the gutter piece after the gutter piece is secured to the structure.

In one form, the method further includes the step of moving the gauging apparatus from one position on the gutter piece, wherein the gauging apparatus is operatively attached, to a second position on the gutter piece, wherein the gauging apparatus is operatively attached. The gauging apparatus is moved lengthwise of the gutter piece between the first and second positions.

BRIEF DESCRIPTION OF THE DRAWINGS

FIG. 1 is a schematic representation of a gauging apparatus, according to the present invention, operatively attached to a gutter piece associated with a roof on a building structure;

FIG. 2 is a view as in FIG. 1 wherein the gauging apparatus may interact with any part of the building structure, as opposed to only a roof thereon;

FIG. 3 is a fragmentary, perspective view of a conventional gutter piece with an associated hanger;

DETAILED DESCRIPTION OF THE PREFERRED EMBODIMENT

Figure 4:
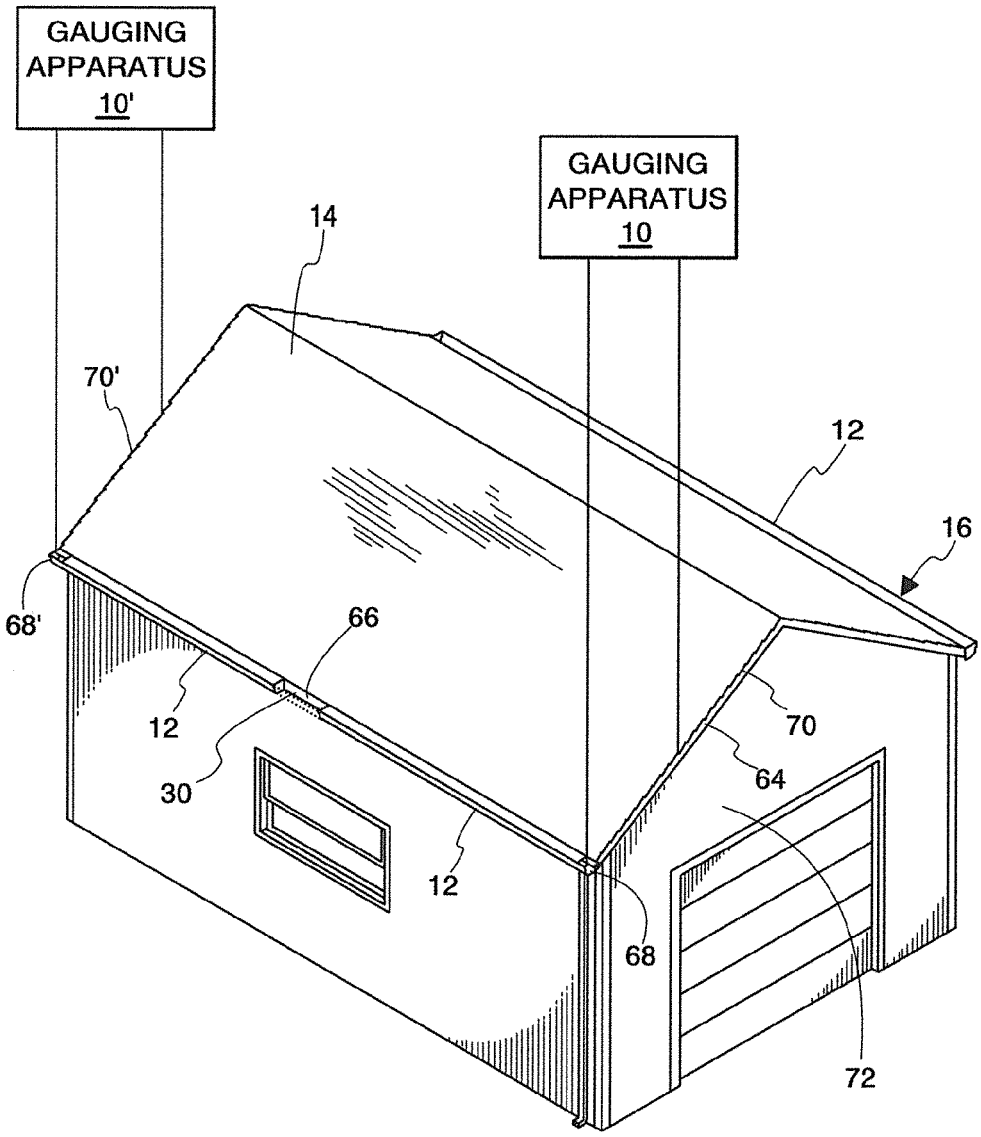
FIG. 4 is a perspective view of one form of structure with separate gauging apparatus, according to the invention, shown schematically and in association with gutter pieces to align the gutter pieces with spaced roof edge surfaces.

In FIG. 1, there is a schematic representation of a gauging apparatus, according to the present invention, at 10, used to facilitate consistent alignment of an elongate gutter piece 12 relative to a roof 14 on a structure 16, which may take any form that supports the roof 14. The schematic representation is intended to encompass virtually an unlimited number of variations of the structure 16, the roof 14 thereon, and the gutter piece 12 that is used to accumulate and redirect water from the roof 14. The precise nature of the gutter piece 12 is not critical to the present invention, nor is the manner in which it is attached to the structure 16 or cooperates with downspouts and/or other water diverting structure. Likewise, the gauging apparatus 10 is depicted schematically as it is contemplated that the gauging apparatus 10 may take virtually an unlimited number of forms, apart from those shown in the embodiments herein.

In FIG. 2, the gauging apparatus 10 is shown schematically as it might interact with the gutter piece 12 and any part of the structure 16, apart from the roof 14.

A typical gutter length/piece 12 is shown in FIG. 3 with a conventional hanger therefor at 18. The depicted gutter piece 12 has an upwardly opening "U" shape, as viewed in cross section taken transversely to the length of the gutter piece 12, which in FIG. 3 projects into the page. The "U" shape bounds a trough for water collection and controlled movement thereof. The gutter piece has a front at 20, a rear at 22, and a bottom at 24.

A rear wall 26 is substantially flat with a rearwardly facing surface 28 to abut to a surface on a fascia or wall 30 on the structure 16. The rear wall 26 continues into a generally flat bottom wall 32 that in turn continues into a front wall 34 that angles upwardly and forwardly from the bottom wall 32. The top region of the front wall 34 is bent to define a vertical portion 36 continuing into a horizontal portion 38. The front wall 34 is reverse bent at the rear end of the horizontal portion 38 to define a cantilevered portion 40 that is angled downwardly and forwardly. The vertical, horizontal and angled portions 36, 38, 40 cooperatively produce a U-shaped portion of the gutter piece 12 that opens downwardly and/or forwardly and defines a receptacle 42 at the front of the gutter piece 12.

The hanger 18 has a J-shaped front portion at 44 that extends rearwardly to a U-shaped hanger component 46 with a downwardly opening receptacle 48 into which an upper edge 50 of the rear wall 26 of the gutter piece 12 is directed with the hanger 18 operatively placed.

To operatively place the hanger 18, the hanger is initially placed in the dotted line position in FIG. 3 to allow the short leg 52 of the J-shaped portion 44 to be directed up to and into the receptacle 42. the hanger 18 is then pivoted in the direction of the arrow 54 fully to the position wherein the upper edge 50 seats in the receptacle 48 to thereby consistently locate the hanger 18 relative to the gutter piece 12. As this occurs, the J-shaped portion 44 wedges at the top region of the front wall 34. More specifically, the "J" shape wedges between a location at the junction of the horizontal portion 38 and angled portion 40 and an angled portion 56 of the front wall 34. The hanger 14 at the J-shaped portion 44 thereof and upper region of the front wall 34 deform slightly under a wedging force to establish a potentially firm connection of the hanger 18 to the front wall 34.

The hanger 18 has a width W parallel to the length of the gutter piece 12. Substantially the entire width W at the J-shaped portions 44 engages the portions 38, 40, 56 on the gutter piece front wall 34 to afford a desired degree of stability, particularly with the wedging interaction of components as described above.

The hanger 18 has a threaded base 58 integrated thereinto. An elongate, threaded fastener 60 is threaded into the base 58 and can be turned to advance in a rearward direction through the base 58 and rear wall 26 and into the fascia/wall 30 that supports the gutter piece 12. The axis 62 of the fastener 60 is angled from horizontal to provide greater stability upon being directed into the fascia/wall 30.

In FIG. 4, one exemplary environment is shown for the inventive gauging apparatus 10. The gauging apparatus 10 is shown on a building structure 16 with a roof 14 supported on fascia rafters 64. Individual gutter pieces 12 are secured to an exposed, vertical surface 66 of the fascia 30, as by using the aforementioned hangers 18.

The gauging apparatus 10 is utilized to facilitate consistent positioning of the gutter piece end 68 lengthwise relative to one edge 70 of the roof 14 where it overhangs the wall 72. A modified form of gauging apparatus 10' is utilized to strategically locate the gutter piece end 68' lengthwise relative to the opposite roof edge 70'. The gauging apparatus 10, 10' are essentially the same and are different only by reason of being left and right handed. The exemplary gauging apparatus 10' will be described in detail with respect to FIGS. 5-8, with the gauging apparatus 10' operatively attached to the gutter piece in each of FIGS. 5 and 6.

The gauging apparatus 10' has a body 74 that may be a single piece or made up of multiple, joined pieces. The gauging apparatus 10' has a front 76 and rear 78. The gauging apparatus 10' has a J-shaped portion 80 at a front region thereof with a base 82, a short/front leg 84, and a longer leg 86. The longer leg 86 is connected to a first wall 88.

The gauging apparatus 10' is designed to engage the gutter piece 12 at spaced first and second locations 90, 92, respectively at the front and rear of the gutter piece 12. It is possible, utilizing the design as described herein for the gauging apparatus 10', that only the front connection between the gauging apparatus 10 and gutter piece 12 is required. In the depicted embodiment, the first wall 88 extends rearwardly fully to the second location 92 where it interacts with the gutter piece 12.

The first wall 88 continues to a locating leg 94 that projects in cantilever fashion from the first wall 88. In this embodiment, the locating leg 94 projects vertically upwardly from the first wall 88 out from the "U" shape of the gutter piece 12.

Figure 5:
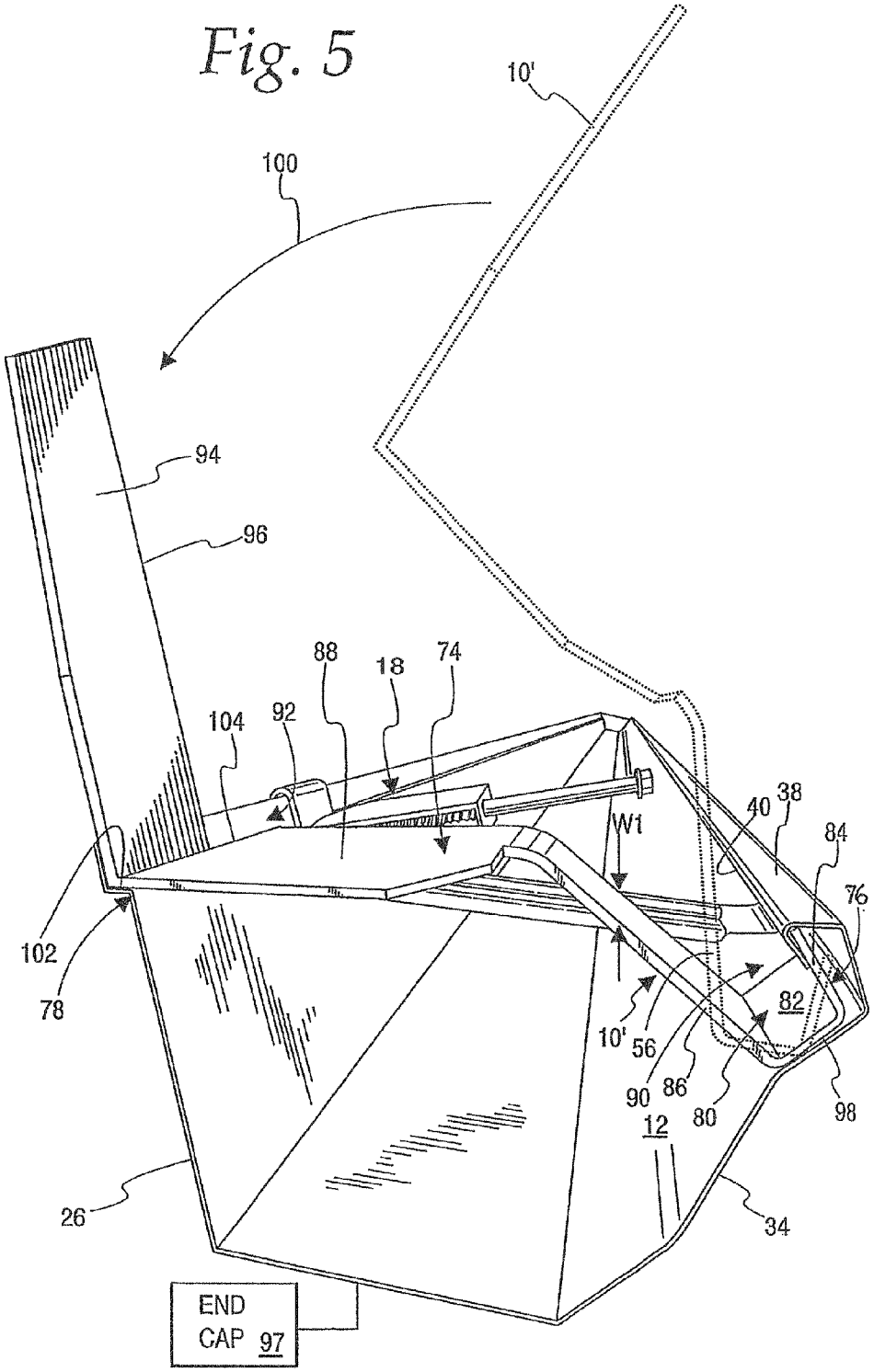
FIG. 5 is a view as in FIG. 3 from an opposite gutter piece end perspective and showing the inventive gauging apparatus operatively attached to the gutter piece.
Figure 6:
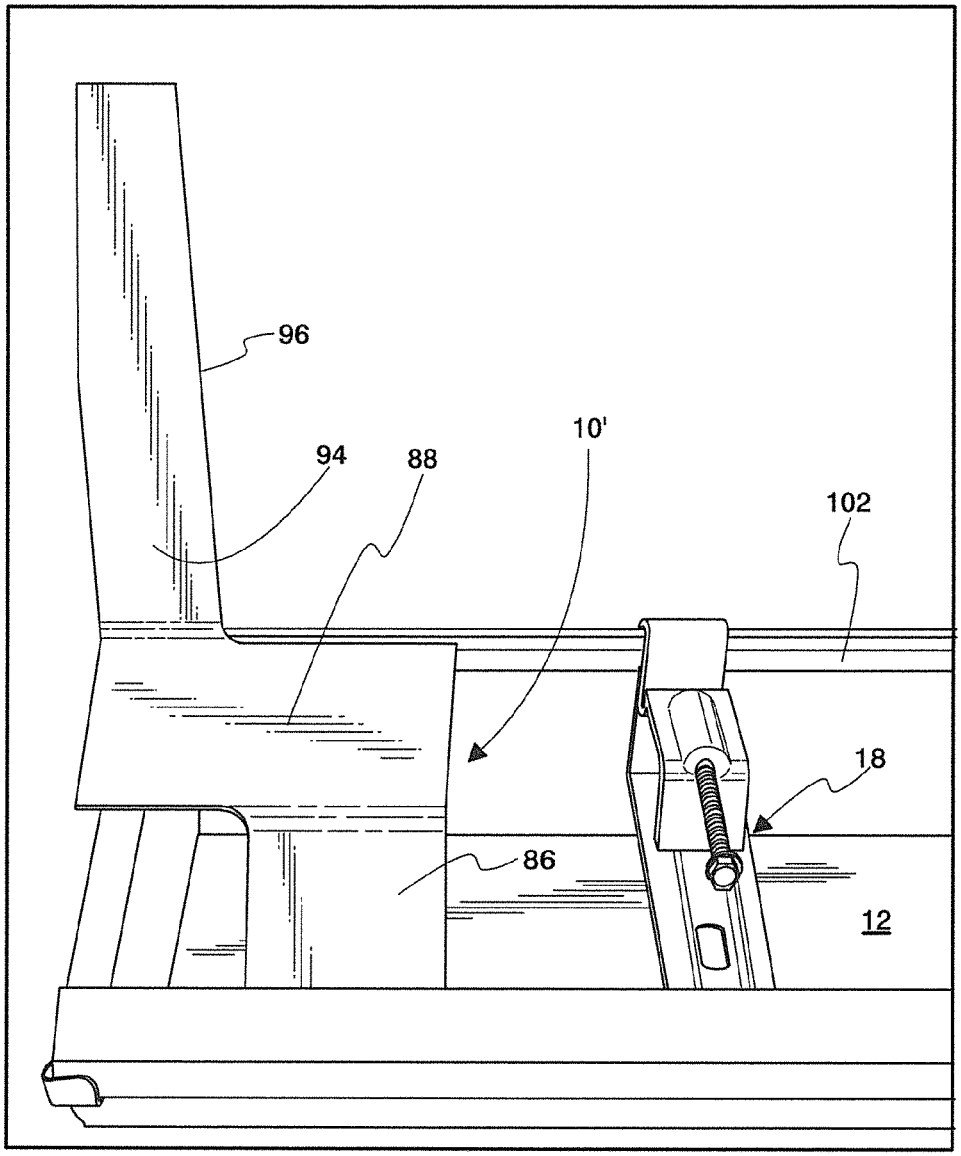
FIG. 6 is a view of the components in FIG. 5 from a different perspective.

In this embodiment, the locating leg 94 has a substantially flat shape residing in a plane that is generally parallel to the length of the gutter piece 12. The locating leg 94 has a vertical edge 96 located to abut the roof edge/surface 70' so as to thereby allow the gutter piece 12 to be consistently aligned with the structure 16 in a direction lengthwise of the gutter piece 12. In FIG. 5, an end cap 97 is provided to define the lengthwise extremity/end 68' of the gutter piece 12.

The locating leg 94 represents one form of projecting component that, according to the invention, projects upwardly to beyond the "U" shape of the gutter piece to abut to a surface/edge on the structure 16 to produce the consistent lengthwise alignment of the associated gutter piece 12. It is conceivable that as an alternative to the depicted form of the locating leg 94, a portion of the gauging apparatus 10 may project to beyond the "U" shape with an edge or surface to engage another part of the structure 16, such as the fascia or wall 30.

The interaction between the front of the gauging apparatus 10' and the front wall 34 of the gutter piece 12 is much the same as the interaction between the front of the hanger 18 and the front wall 34 of the gutter piece 12. More specifically, the base 82 of the J-shaped portion 80 has a surface 98 that facially engages the angled front wall portion 56 over the full width W1 of the J-shaped portion. This width may be on the order of 1-3 inches, but it is contemplated that it could be a lesser or greater dimension. The front/shorter leg 84 is directed into the receptacle 42 with the gauging apparatus 10' in the dotted line position in FIG. 5. By then pivoting the gauging apparatus 10' in the direction of the arrow 100, the J-shaped portion is firmly wedged between the portions 38, 40 and angled portion 56, all on the front wall 34 of the gutter piece 12. As mentioned, the parts can be relatively configured so that this wedging action alone produces forces between the front of the gutter piece 12 and gauging apparatus 10' adequate to maintain the gauging apparatus 10' operatively attached and prevent inadvertent shifting of the gauging apparatus 10' along the length of the gutter piece 12.

Additional stability is optionally afforded by causing the gauging apparatus 10' to fully span between the front and rear walls 34, 26 of the gutter piece 12. This additional stability can be provided by wedging the gauging apparatus 10' between the front and rear gutter piece walls 34, 26 or by simply causing the gauging apparatus 10' to abut the rear wall 26, as described hereinbelow. The wedging/spanning locations are the aforementioned first and second locations 90, 92, respectively at the front and rear of the gutter piece 12.

The rear wall 26 of the gutter piece 12 has an upwardly facing ledge 102 adjacent the top thereof. The first wall 88 on the engaging apparatus 10' may be supported on this ledge 102 at the aforementioned second location 92.

The first wall 88 is also shown with a substantially straight edge 104 that can abut to the rear wall 26 along the length of the edge 104 to provide added stability to the operatively attached gauging apparatus 10' to avoid lengthwise sliding and/or skewing thereof relative to the length of the gutter piece 12.

With the configuration of parts as shown, it is possible to releasably operatively attach the gauging apparatus 10' to the gutter piece 12 through a simple manipulation of the gauging apparatus 10', as described. The gauging apparatus 10' can thus be releasably operatively attached without requiring any separate fasteners. Separate fasteners might be utilized to more positively secure the gauging apparatus 10'. The fasteners may be permanently installed or releasable. The former would be practical in the event the gauging apparatus 10' is to remain operatively attached after gutter installation. Suitable fasteners may take many different forms.

The generic depiction of the gauging apparatus 10' herein is intended to encompass any structure that can interact with a gutter piece, in virtually unlimited different ways, with or without fasteners, to be maintained releasably or permanently in an operatively attached relationship. While frictional securement is a preferred option, frictional holding is not required.

The entire gauging apparatus 10' is shown to be made from a single piece. As one example, the single piece may be shaped from a flat metal starting blank. Alternatively, the gauging apparatus 10' might be molded to the depicted shape. The gauging apparatus 10' may be strategically cut off at various locations, as at 106, 108, to eliminate sharp edges.

Figure 9:
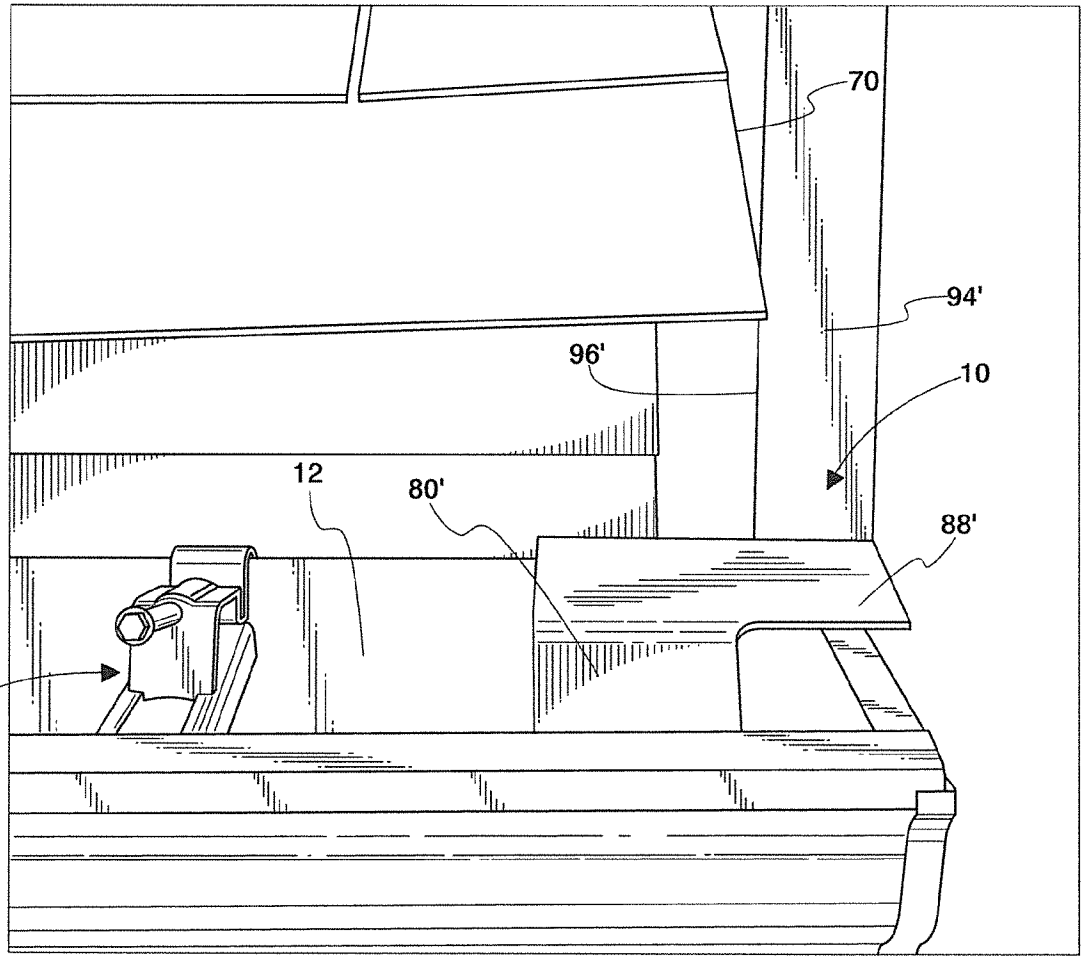
FIG. 9 is a fragmentary, perspective view of a portion of the structure in FIG. 4, opposite the end shown in FIG. 5, where an opposite-handed form of the inventive gauging apparatus is utilized.
Figure 8:
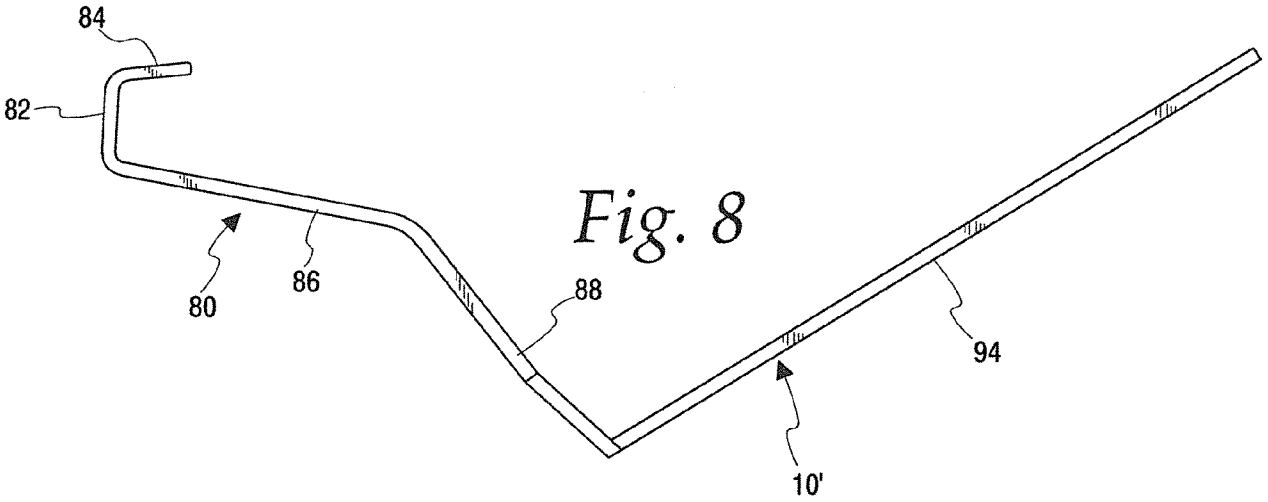
FIG. 8 is an enlarged, end elevation view of the gauging apparatus.

FIG. 9 depicts the opposite-handed gauging apparatus 10 operatively attached to the gutter piece 12 and with an edge 96', corresponding to the edge 96, abutted to the roof edge/surface 70. The gauging apparatus 10, 10', as noted above, are essentially the same, with one being a mirror image of the other. Essentially, the first wall 88' extends lengthwise of the gutter piece 12 beyond the J-shaped portion 80' in an opposite lengthwise direction as compared to the J-shaped portion 80. This situates the locating leg 94' lengthwise at the opposite lengthwise location.

Figure 10:
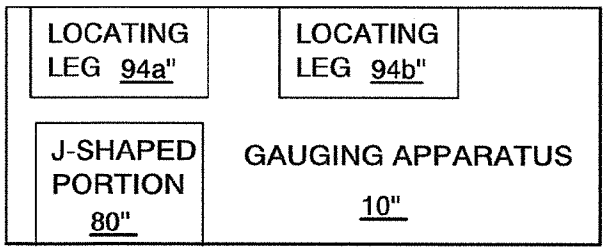
FIG. 10 is a schematic representation of a universal form of gauging apparatus, according to the invention, that can be used at either end of a roof.

As shown in FIG. 10, a further modified form of gauging apparatus 10" may have a universal construction that could be used at either end of the roof. The same J-shaped portion 80" may be employed with separate locating legs **94*a*", 94*b*" incorporated. The locating legs 94*a*", 94*b*" might have to be reconfigurable or repositionable so as not to interfere with the roof when not being utilized. Alternatively, one locating leg might be repositionable to be usable at both roof edge surfaces 70, 70'**.

Figure 7:
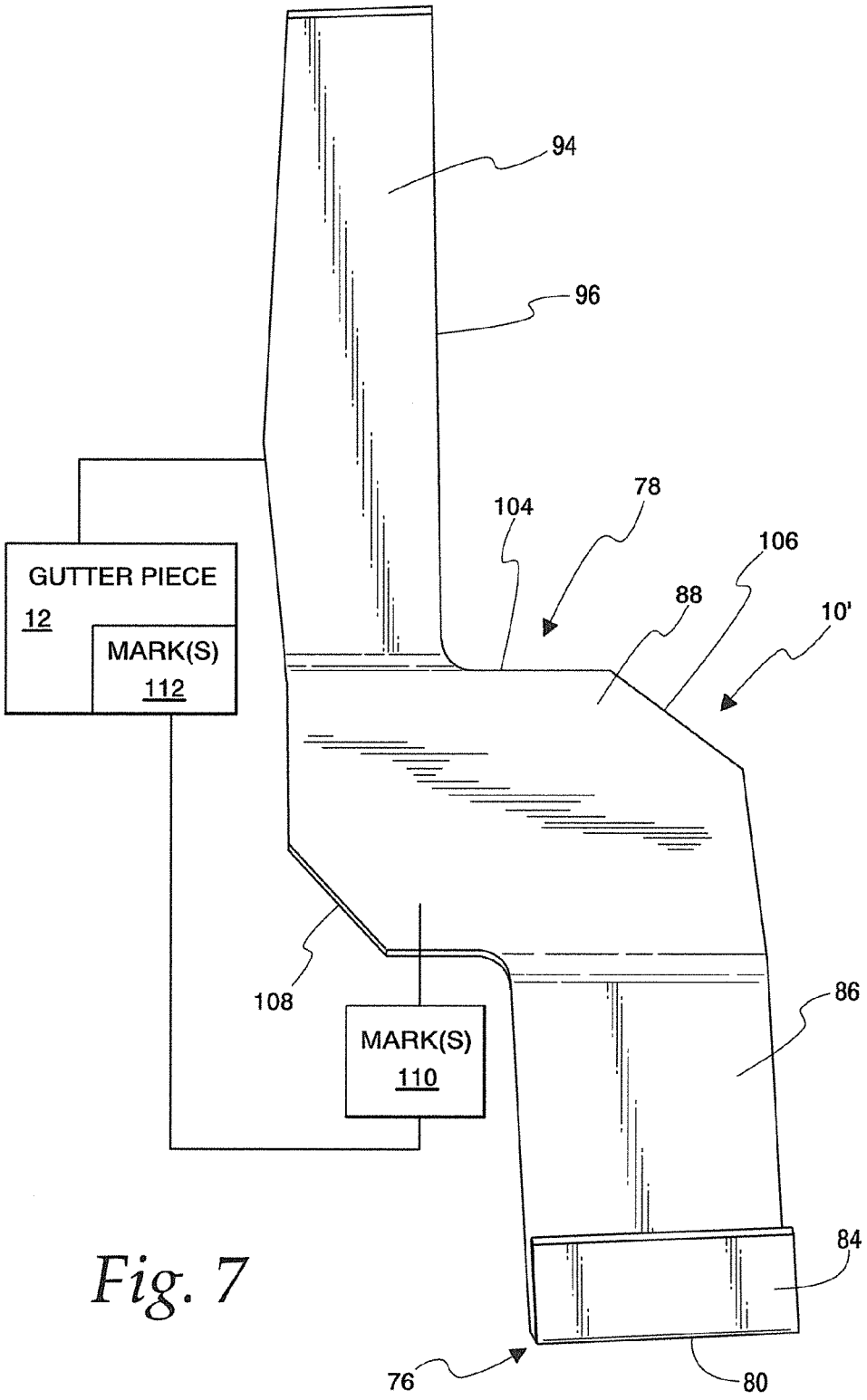
FIG. 7 is an enlarged, perspective view of the inventive gauging apparatus separated from an associated gutter piece.

As shown in FIG. 7, one or more locating marks 110, 112 may be provided on the gauging apparatus 10' and/or gutter piece 12. The invention contemplates that virtually an unlimited number of marks 110 may be provided on the gauging apparatus 10' to be alignable with either a mark or marks on the gutter piece 12 or some part of the gutter piece 12 or other part of the structure 16. Likewise, a mark or marks 112 on the gutter piece 12 may be utilized to align either with a part of the gauging apparatus 10' and/or a mark or marks 110 thereon.

Through the marks 110, 112, consistent placement of the gauging apparatus 10' may be effected as it is operatively attached. The marks may be chosen and placed to allow a single, predetermined, lengthwise relationship to be established between the gauging apparatus 10' and gutter piece 12 and/or structure 16. Alternatively, multiple, selectable, predetermined lengthwise relationships may be established through the selective alignment of the marks 110, 112.

Figure 11:
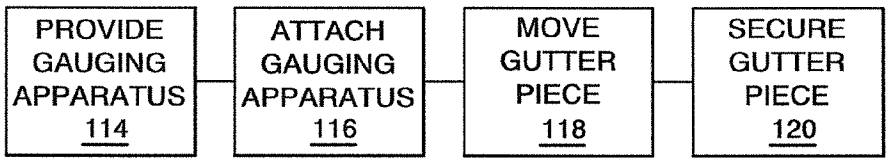
FIG. 11 is a flow diagram representation of a method of installing a gutter piece, according to the present invention.
Figure 14:
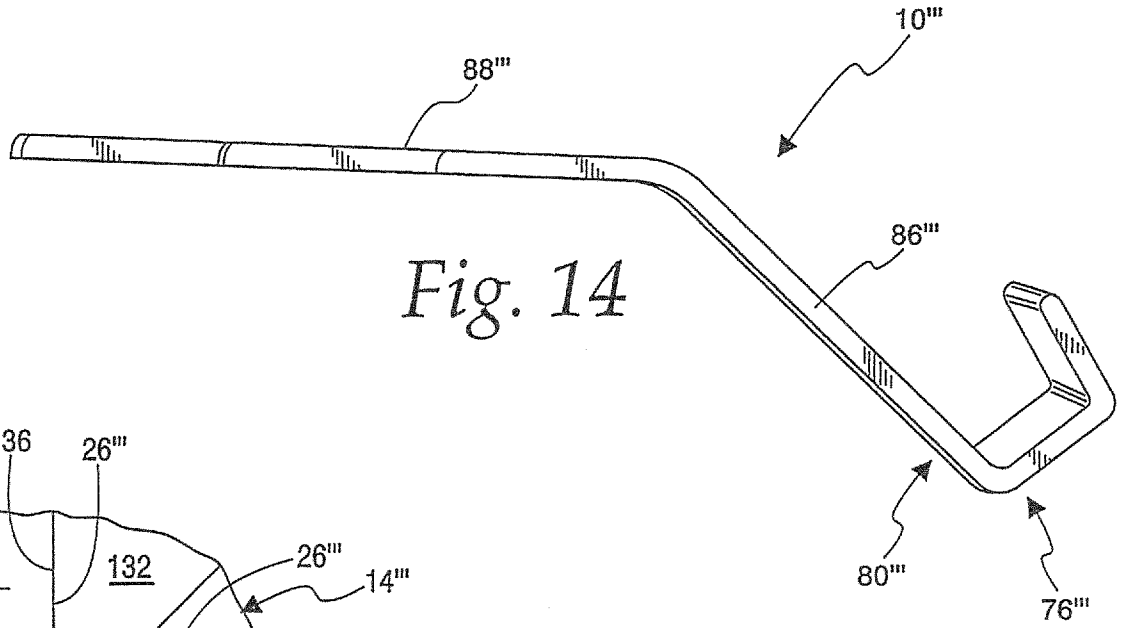
FIG. 14 is a side perspective view of the gauging apparatus in FIG. 12.
Figure 12:
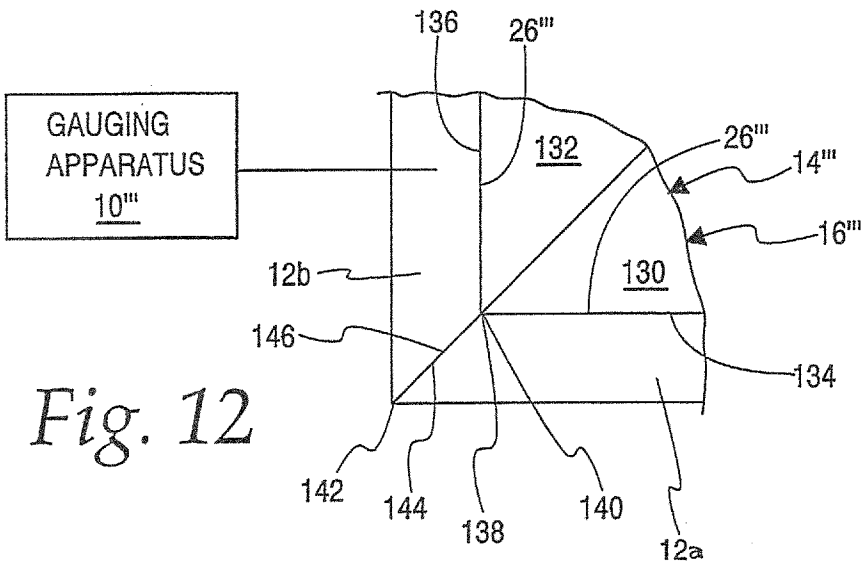
FIG. 12 is a fragmentary plan view of a structure having a hipped roof and with a further modified form of gauging apparatus operatively attached to one of two cooperating gutter pieces.
Figure 13:
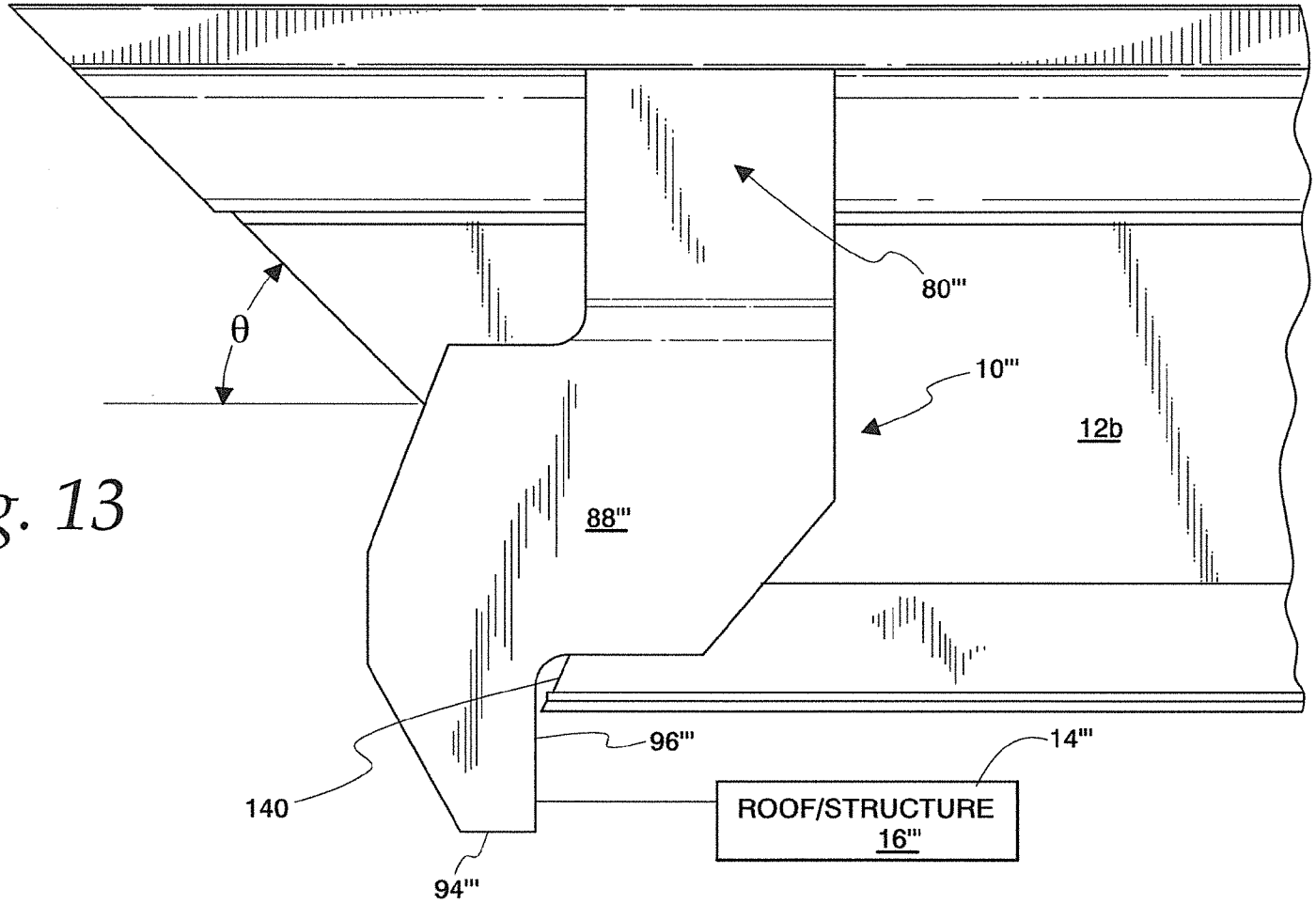
FIG. 13 is a fragmentary plan view of one specific form of the gauging apparatus in FIG. 12 operatively attached to the gutter piece.
Figure 15:
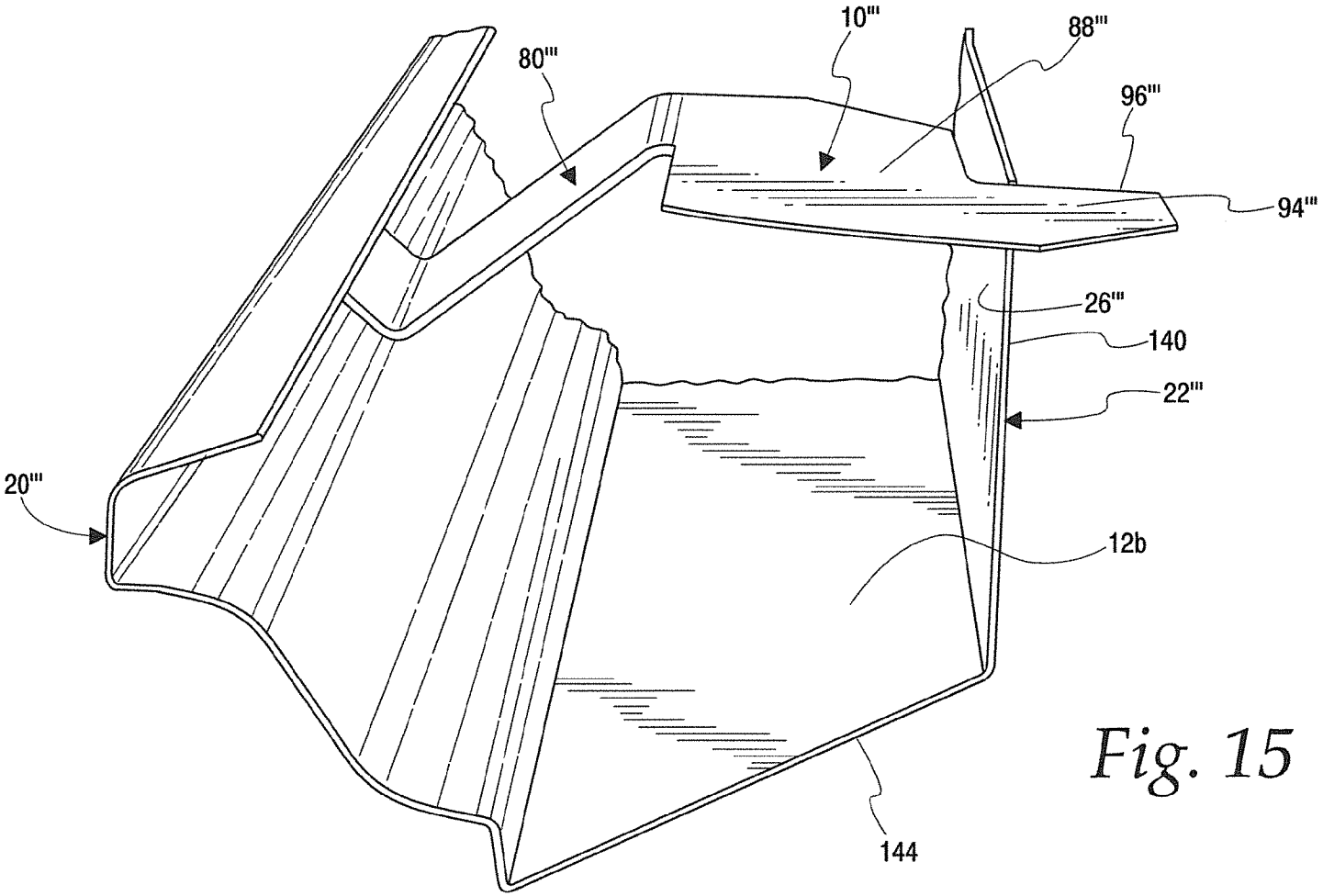
FIG. 15 is a fragmentary view of the components in FIG. 13 from a different perspective.

With the structure as described above, a gutter piece can be installed, as described in flow diagram form in FIG. 11. As shown at block 114, a gauging apparatus is provided, as described above. The gauging apparatus is attached, as shown at block 116. With the gauging apparatus attached, the gutter piece can be moved to abut a surface on the roof and/or supporting structure as shown at block 118. As shown at block 120, the gutter piece, once operatively situated, can be secured to the structure.

According to the method, the gauging apparatus can be separated from the gutter piece once the gutter piece is secured. It is conceivable that the gauging apparatus might be left in place on the gutter piece after securement.

The method also contemplates operatively attaching the gauging apparatus in any of potentially a plurality of predetermined positions that may be assisted by marks on the gauging apparatus, structure, and/or gutter. Of course, it is possible that a single predetermined location may be contemplated, in which case the gauging apparatus can be made accordingly.

In FIGS. 12-15, a further modified form of gauging apparatus, according to the invention, is shown at 10'''. The gauging apparatus 10''' has particular utility in assisting the installation of separate gutter pieces 12*a*, 12*b* on a hipped roof 14'''. The basic hipped roof construction has sloping ends and sides, with an exemplary sloping end and side 130, 132, respectively, shown partially in FIG. 12. The end 130 terminates at a fascia surface 134 with the side 132 terminating at a fascia surface 136. With the hipped roof, the gauging apparatus 10''' is utilized to match angled ends of pieces 12*a*, 12*b* at a corner 138 where the fascia surfaces 134, 136 meet, as opposed to consistently setting overhang.

For this purpose, the gauging apparatus 10''' has the same basic components as the gauging apparatus 10', to include a similarly formed J-shaped portion 80''' at a front 76''' thereon, with a longer leg 86''' that blends into a corresponding first wall 88'''.

The primary distinction resides in the configuration of the locating leg 94''' that extends substantially horizontally and rearwardly past the rear wall 26''' of the exemplary gutter piece 12*b*. The edge 96''' on the locating leg 94''', corresponding to the edge 96', is a horizontally extending edge that is abuttable to the fascia surface 134 to align the edge 140 of the rear wall 26''' with the corner 138. The gutter piece 12*b* is cut at an angle θ, on the order of 45°, between the edge 140 and a top extremity point 142. As viewed in plan, the gutter piece 12*b* has a continuous edge 144 between the front 20''' and rear 22''' of the gutter piece 12*b*.

With this arrangement, the edge 144 will be mateable with a corresponding edge 146 on the gutter piece 12*a* so that the lengths of the gutter pieces 12*a*, 12*b* are essentially orthogonal to each other, whereupon the respective rear walls 26''' of the gutter pieces 12*a*, 12*b* are presented for suitable attachment at their respective fascia surface 134, 136.

In the same manner that the gauging apparatus 10 is made opposite-handed to the gauging apparatus 10', a gauging apparatus can be made opposite-handed to the gauging apparatus 10''' to facilitate controlled situation of the gutter piece 12*d* at its respective fascia surface 136. Alternatively, a universal construction can be devised, corresponding to that for the gauging apparatus 10'''.

Still other variations are contemplated, with each preferably having a locating leg with an associated edge, regardless of its orientation, that is abuttable to a surface/edge on a building structure, be it on the roof or elsewhere.

With all embodiments, the particular dimensions of the gauging apparatus can be selected based upon the particular application.

It should also be pointed out that the exemplary gutter configuration should not be viewed as limiting. The inventive concept can be employed with, and adapted to, virtually a limitless number of different gutter shapes and constructions.

The foregoing disclosure of specific embodiments is intended to be illustrative of the broad concepts comprehended by the invention.

The invention claimed is:

1. In combination:

a) a gutter piece having a length between spaced ends, a front a rear, a bottom and a top, the gutter piece having an upwardly opening "U" shape, as viewed in cross-section taken transversely to the length of the gutter piece, for accumulating water and guiding accumulated water in a lengthwise direction;

b) a structure upon which the gutter piece is fixedly attached in a first position; and c) a gauging apparatus that is operatively attached to the gutter piece and having a front and rear and a projecting portion with an edge or surface that abuts a surface on the structure to which the gutter piece is attached that faces lengthwise relative to the gutter piece so as to thereby block the gutter piece from moving in a first direction relative to the structure generally parallel to the length of the gutter piece during alignment of the gutter piece preparatory to fixing the gutter piece in the first position so that the gutter piece is consistently aligned with the structure in a direction lengthwise of the gutter piece, wherein the edge or surface resides between the spaced ends of the gutter piece wherein the gauging apparatus is not fixed to the structure so as to be separable from the structure with the gutter piece fixedly mounted in the first position.

2. The combination according to claim 1 wherein the gauging apparatus is operatively attached to the gutter piece and usable without requiring any separate fasteners.

3. The combination according to claim 1 wherein there is a U-shaped portion opening at least one of downwardly and forwardly and defining a receptacle at the front of the gutter piece and the gauging apparatus has a front leg that is directed into the receptacle with the gauging apparatus operatively attached.

4. The combination according to claim 3 wherein the gauging apparatus is one of: a) wedged; and b) spanning between spaced first and second parts of the gutter piece that are respectively at first and second locations spaced in a direction between the front and rear of the gutter piece.

5. The combination according to claim 4 wherein the gauging apparatus has a "J"-shaped portion with a base, a short leg, that is the front leg, and a longer leg, the longer leg connected to a first wall that extends rearwardly to the second location.

6. The combination according to claim 5 wherein the gutter piece has an upwardly facing ledge and the first wall is supported on the upwardly facing ledge at the second location.

7. The combination according to claim 5 wherein the projecting portion of the gauging apparatus further comprises a locating leg that has a length projecting in cantilever fashion from the first wall to beyond the "U" shape of the gutter piece.

8. The combination according to claim 7 wherein the locating leg projects vertically upwardly from the first wall.

9. The combination according to claim 7 wherein the locating leg has a substantially flat shape residing in a plane that is generally parallel to the length of the gutter piece.

10. The combination according to claim 7 wherein the gauging apparatus has a body with a single piece defining the locating leg, the first wall, and the J-shaped portion.

11. The combination according to claim 10 wherein the single piece is shaped from a flat blank of metal.

12. The combination according to claim 5 wherein the first wall has a substantially straight edge that abuts to the gutter piece along the length of the gutter piece.

13. The combination according to claim 3 wherein the gauging apparatus is wedged into the receptacle so as to be maintained operatively attached through wedging forces produced between the gutter piece and gauging apparatus at the front of the gutter piece.

14. The combination according to claim 1 wherein there is at least one locating mark on at least one of the gutter piece and gauging apparatus usable to facilitate consistent placement of the gutter piece and gauging apparatus in a predetermined lengthwise relationship.

15. The combination according to claim 14 wherein there are a plurality of locating marks on one of the gutter piece and gauging apparatus usable to facilitate consistent placement of the gutter piece and gauging apparatus in first and second different pre-determined lengthwise relationships.

16. The combination according to claim 1 wherein the gauging apparatus fully spans between the front and rear of the gutter piece.

17. A method of installing a gutter piece on a structure, the method comprising the steps of a) providing i) a gutter piece having a length, a front, a rear, a bottom and a top, the gutter piece having an upwardly opening "U" shape, as viewed in cross-section taken transversely to the length of the gutter piece, for accumulating water and guiding accumulated water in a lengthwise direction; and ii) a gauging apparatus having a front and rear and a projecting portion, b) operatively attaching the gauging apparatus to the gutter piece;

c) moving the gutter piece with the operatively attached gauging apparatus in a first direction relative to the structure generally parallel to the length of the gutter piece so that the projecting portion abuts a surface on the structure facing oppositely to the first direction to block the gutter piece against further movement n the first direction in a desired position;

d) securing the gutter piece to the structure; and e) separating the gauging apparatus from the gutter piece.

* * * * *

UNITED STATES PATENT AND TRADEMARK OFFICE

CERTIFICATE OF CORRECTION

PATENT NO. : 8,621,821 B1
APPLICATION NO. : 13/781032
DATED : January 7, 2014
INVENTOR(S) : Robert J. Wallace, Jr.

It is certified that error appears in the above-identified patent and that said Letters Patent is hereby corrected as shown below:

In the Claims

Column 10, lines 6-26 should read

17. A method of installing a gutter piece on a structure, the method comprising the steps of:

a) providing i) a gutter piece having a length, a front, a rear, a bottom and a top, the gutter piece having an upwardly opening "U" shape, as viewed in cross-section taken transversely to the length of the gutter piece, for accumulating water and guiding accumulated water in a lengthwise direction; and ii) a gauging apparatus having a front and rear and a projecting portion, b) operatively attaching the gauging apparatus to the gutter piece;

c) moving the gutter piece with the operatively attached gauging apparatus in a first direction relative to the structure generally parallel to the length of the gutter piece so that the projecting portion abuts a surface on the structure facing oppositely to the first direction to block the gutter piece against further movement in the first direction in a desired position;

d) securing the gutter piece to the structure; and e) separating the gauging apparatus from the gutter piece.

Signed and Sealed this
Eighteenth Day of March, 2014

Michelle K. Lee

Michelle K. Lee
*Deputy Director of the United States Patent and Trademark Office*